United States Patent [19]

McPhee

[11] Patent Number: 4,728,016

[45] Date of Patent: Mar. 1, 1988

[54] CLOTHES DRYING HANGER

[76] Inventor: Charles J. McPhee, 8562 Larthorn Dr., Huntington Beach, Calif. 92646

[21] Appl. No.: 800,722

[22] Filed: Dec. 27, 1985

[51] Int. Cl.[4] ..... A47G 25/28

[52] U.S. Cl. ..... 223/85; 223/89; 223/94; 211/116; 211/118; 248/317; D6/317; D32/58

[58] Field of Search ..... 211/118, 113, 119, 116; 248/317, 318, 339; 223/85, 89, 94, 88, DIG. 1; D6/315, 317, 322; D32/58

[56] References Cited

U.S. PATENT DOCUMENTS

| | | | |
|---|---|---|---|
| D. 35,247 | 10/1901 | Jacobs | D6/322 |
| 360,114 | 3/1887 | Schoonmaker | 211/119 |
| 1,551,769 | 9/1925 | Paddington | 223/88 |
| 2,360,119 | 10/1944 | Gallagher | 223/89 |
| 2,395,210 | 2/1946 | Baril et al. | D6/315 X |
| 2,998,903 | 9/1961 | Day | D6/317 X |
| 3,207,392 | 9/1965 | Ericson | 223/85 |
| 3,225,977 | 12/1965 | Gandy | D6/317 X |
| 3,370,715 | 2/1968 | Kolozsvari | 211/116 |
| 4,004,721 | 1/1977 | Ross | 223/89 |
| 4,121,720 | 10/1978 | Hayes | 248/317 X |

FOREIGN PATENT DOCUMENTS

| | | | |
|---|---|---|---|
| 582262 | 12/1924 | France | 211/113 |
| 185106 | 7/1936 | Switzerland | 223/93 |
| 2090182 | 7/1982 | United Kingdom | 223/85 |

*Primary Examiner*—Andrew M. Falik

*Attorney, Agent, or Firm*—Tilton, Fallon, Lungmus

[57] ABSTRACT

A hanger especially adapted for supporting washed garments for rapid drying. The hanger includes a garment-supporting hoop having a central hub with a suspension hook capable of being detached and/or folded for storage and travel.

12 Claims, 10 Drawing Figures

CLOTHES DRYING HANGER

BACKGROUND AND SUMMARY

Garment-supporting frames for drying, stretching, or shaping are well known. For example, U.S. Pat. No. 877,226 discloses a shirt dryer formed of wire; U.S. Pat. No. 2,108,308 discloses wire dress and blouse dryers; U.S. Pat. No. 942,525 shows a skirt hanger and stretcher formed of slidable elements; U.S. Pat. No. 3,063,607 shows a skirt shaper composed of a multiplicity of interconnected arcuate segments; U.S. Pat. No. 2,923,449 reveals a skirt dryer of umbrella-like construction; and U.S. Pat. Nos. 2,094,042 and 2,118,786 present elaborate clothes-drying units that include impellers for the circulation of air. In general, prior devices for supporting garments for drying have been intended for home or commercial use and have functioned as stretching or shaping devices as well as supporting means. They have often been cumbersome, complex, and expensive in construction, and clearly unsuitable for use by a traveler who might find it advantageous to pack a clothes-drying device into her (his) luggage so that garments might be washed in a hotel room and quickly dried for wear shortly thereafter.

While it is a common practice at home or when traveling to wash garments and hang them up to dry on plastic hangers, shower curtain rods, towel bars, and the like, such expedients are often ineffective to the extent that the garments dry slowly and may not be fully dry when they are needed for wear. Problems of slow drying could also arise with some of the devices disclosed in the aforementioned patents; however, since those devices are not primarily intended for use by travelers, the dilemma presented to a traveler when clothing is urgently needed for wearing or packing but is too damp for either purpose is not fully considered.

Accordingly, this invention is directed to a clothes-drying hanger of simple and highly effective construction that may be easily stored or packed for home use or for travel. Specifically, the hanger supports clothes in open condition—that is, with layers or panels of cloth separated from each other—so that air may circulate more effectively and greatly reduce drying time. In addition, because the clothing is allowed to drape naturally, wrinkles that might otherwise develop because of one fabric surface clinging to another are avoided. The device may be used by men, women, and children alike, although it is particularly useful for supporting feminine undergarments, bathing suits, leotards, tights, and workout clothing.

The hanger takes the form of a hoop having single or multiple radially-extending arm(s) that extend to a central hub. The hub, arm(s), and hoop all lie in essentially the same plane and are preferably formed of rigid, durable, and lightweight plastic material. Attachment means in the form of a hook extends from the hub in a direction normal to the plane of the hoop when the hanger is in use. The interconnection between the hook and the hub may be detachable, or pivotal, or both, with the result that the hanger may be easily packed for travel or stored until use is required. In one embodiment, the hoop may also be enlarged or expanded for use and partially collapsed for storage or travel.

Other features, advantages, and objects of the invention will become apparent from the drawings and specification.

DETAILED DESCRIPTION OF PREFERRED EMBODIMENTS

Figure 3:
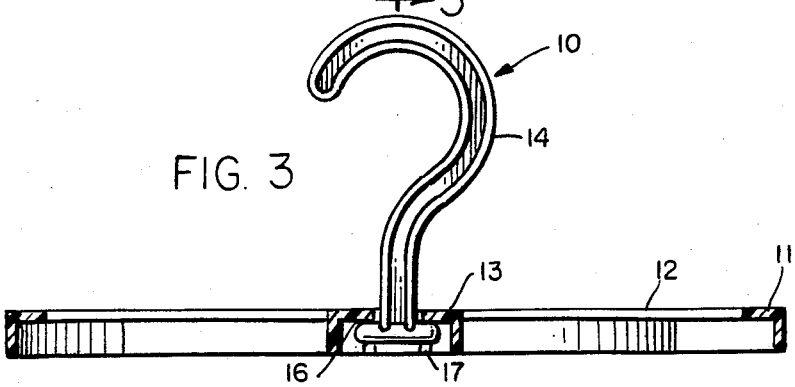
FIG. 3 is a sectional vertical view taken along line 3—3 of FIG. 2.

Referring to the drawings, the numeral 10 generally designates a hanger comprising a hoop portion 11, a plurality of radially extending arm portions 12, a central hub portion 13, and suspension means in the form of a hook 14. The hoop, arm, and hub portions are preferably integrally formed of a tough, durable, rigid plastic material such as, for example, polypropylene. As shown most clearly in FIGS. 1 and 3, the hoop, arm, and hub portions all lie generally along the same plane.

In the illustration given, the hoop portion 11 is of circular configuration although, if desired, some limited variation from that shape may be made. For example, the hoop portion might be of elliptical or oval shape. In any case, hub portion 13 is centrally located with arms 12 radiating outwardly at uniformly circumferentially-spaced locations. Four such arms are shown, but a greater or smaller number might be provided.

Figure 4:
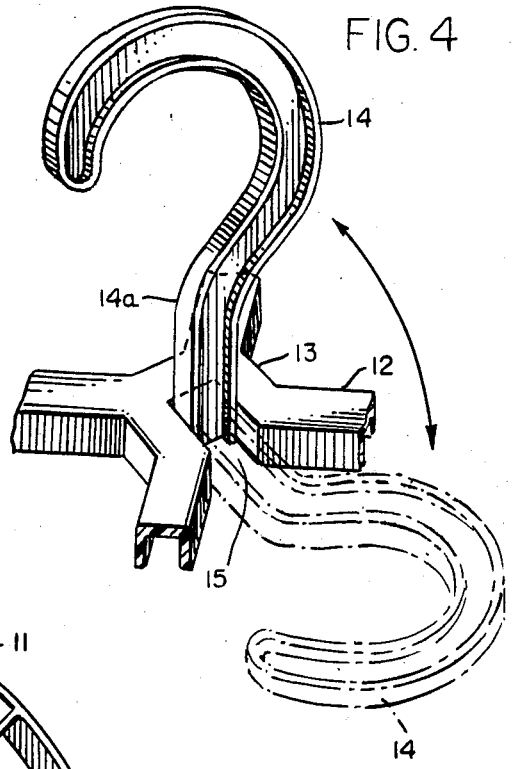
FIG. 4 is a fragmentary perspective view illustrating the relationship of the hub and hook elements.
Figure 2:
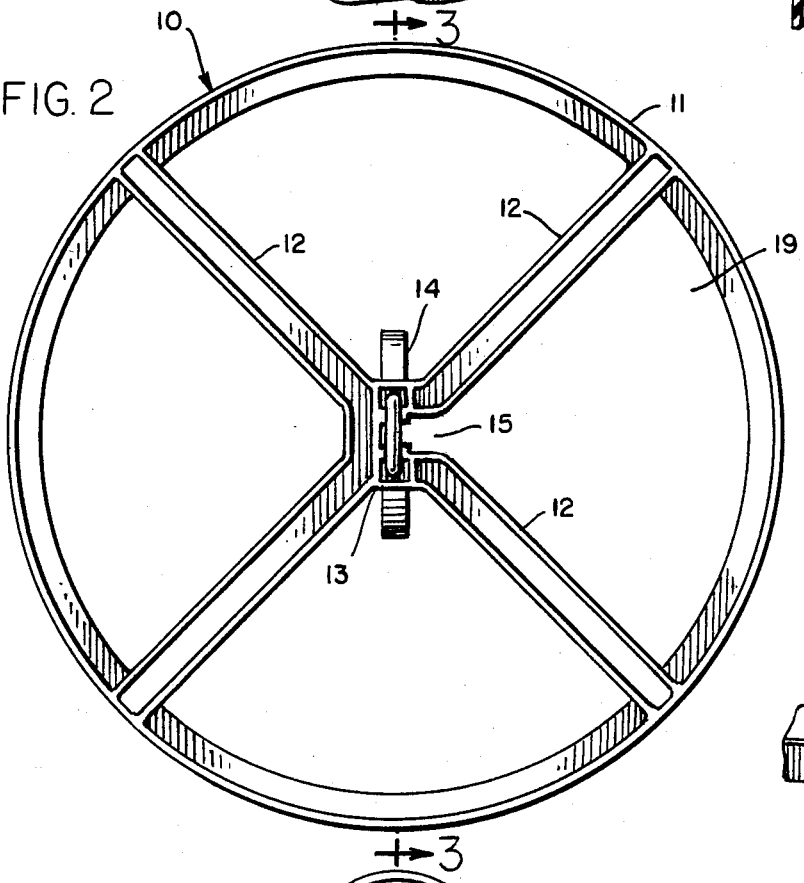
FIG. 2 is a bottom plan view of the hanger taken along line 2—2 of FIG. 1.

Each arm is in the form of a channel of inverted U-shaped cross sectional configuration as clearly depicted in FIG. 4. Such a construction yields high strength and rigidity while minimizing the weight of the hanger. Hoop portion 11 might also be channel-shaped in cross section, although the inverted L-shaped cross sectional configuration shown in the drawings (FIG. 3) has been found effective. The diameter of the hoop portion may be varied but, in general, should fall within the range of about 6 to 15 inches, a diameter of approximately 10 inches being found particularly suitable.

The central hub portion 13 is formed as a continuation of the channel-shaped arm portions 12 and is generally rectangular in shape. Of particular importance is the fact that hub 13 has a central recess 15 that, in the embodiment shown, is defined by three planar side walls 16 extending axially through the hub portion and is open along its fourth side. The two opposing walls 16 are provided with notches or apertures 17 that extend to the lower edges of the walls 16. Such apertures are generally circular in shape but with entrance portions leading from the lower edges of walls 16 that are slightly narrower than the diameter of each such aperture.

Figure 5:
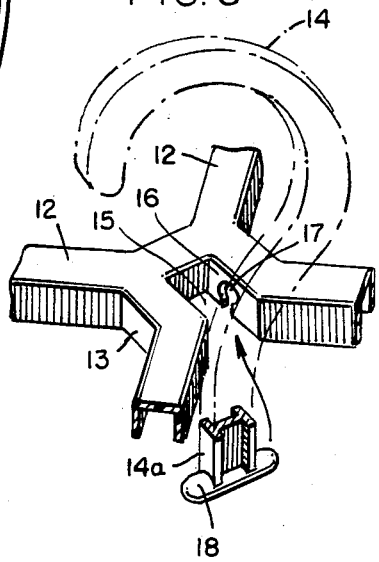
FIG. 5 is a further perspective view showing the hub and arm construction and the mounting of a hook with respect thereto.

Hook 14 has the typical configuration and proportions of the hook portion of a standard clothes hanger and, like the other components of the device, is preferably formed of polypropylene or other rigid plastic material. The stem 14*a* of the hook is equipped at its lower end with rounded but otherwise generally cylindrical projections 18 that may be snapped into apertures 17 to function as pivotal connections between the hook and hub portion 13. The relationship is shown most clearly in FIGS. 3 and 5. There is sufficient resilience or flexibility to the material of which the hanger is formed to permit projections 18 to be forced upwardly into the apertures 17 through their entrances and thereafter be retained within such apertures unless substantial downward force is exerted on the hook in relation to hub portion 13.

Detachability of the hook is important but may not be essential if the hanger may be otherwise collapsed for storage and/or travel. In the embodiment shown in the drawings, the projections 18 may rotate within apertures 17, allowing the hook to swing downwardly towards the open side of recess 15 and into generally coplanar relationship with arms portions 12 and hoop portion 11 (FIG. 4). Conversely, such pivotal action of the hook is important but not absolutely essential if the hook may be readily attached and detached from the hub for packing and storage. In the preferred embodiment, the hook is capable of both functions with ease of attachability being significant during initial assembly, whether by the manufacturer or user. Once assembled, the hanger would then normally be collapsed for packaging, shipment, storage, and travel simply by swinging the hook into the broken-line position shown in FIG. 4.

In use of the hanger, hook 14 is extended and suspended from a shower curtain rod or other support. The diameter of the hoop portion is such that it exceeds the diameter of the waistband of a typical garment such as, for example, slacks, shorts, half slip, pajama bottoms, panties, pantyhose, tights, leotards, bathing trunks, etc. When any of such items are supported with their waist sections extending about the hoop portion, the layers of fabric are held apart and the rate of drying is greatly accelerated. Not only are the layers of fabric separated from each other, but a chimney effect is established that promotes air circulation and further accelerates drying. The drying action developes from both the inside and outside surfaces of the supported garment, with a doubling of the evaporative surfaces resulting in a commensurate increase in the drying rate. Furthermore, since the layers or panels of cloth are held apart and are allowed to drape naturally, wrinkles that might otherwise develop if the surfaces remained in contact while drying are avoided.

Figure 1:
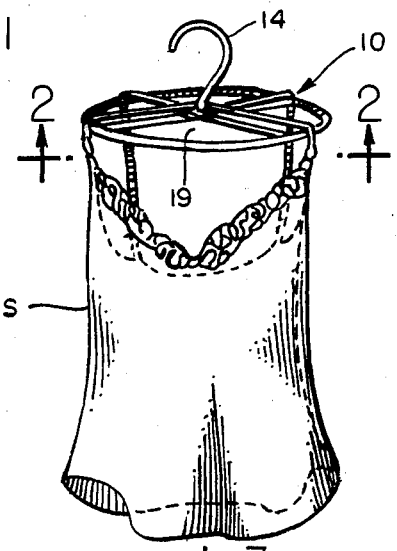
FIG. 1 is a perspective view of a clothes-drying hanger embodying the invention, the hanger being shown as it might be used to support a woman's slip.

FIG. 1 illustrates the hanger as it would be used to support a woman's slip S. The straps of the slip are simply extended over the top of the hoop and may be crossed at the stem of the hook. Again, the garment is allowed to dry with both the inside and outside surfaces exposed to the circulation of air.

It is believed apparent that the effectiveness of the hanger in facilitating the rapid drying of washables arises not only because of its configuration and orientation, but also because of the large openings 19 defined by the hoop and arm portions 11 and 12. Such openings should constitute at least 80 percent, and preferably over 90 percent, of the area defined by the periphery of the hoop portion 11.

Figure 6:
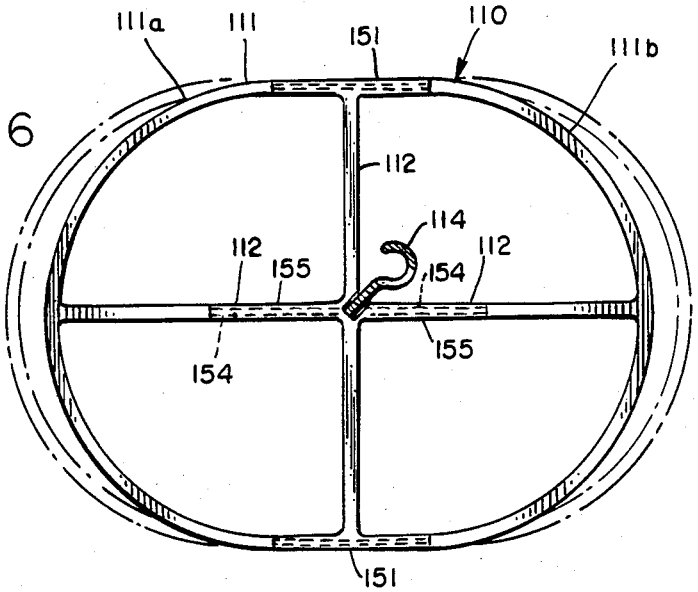
FIG. 6 is a top plan view of a hanger constituting a second embodiment of the invention, such hanger being similar to the first embodiment except that it is expandable for use and contractable for storage or travel.
Figure 7:
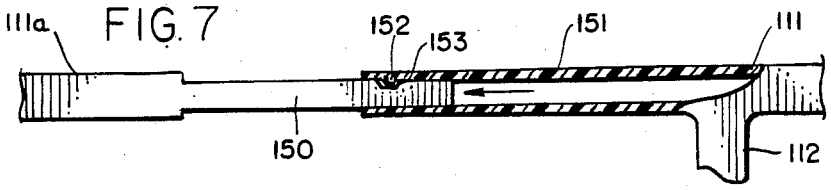
FIG. 7 is an enlarged fragmentary sectional view illustrating the telescoping interconnection between the members of the hoop depicted in FIG. 6.

The embodiment illustrated in FIGS. 6 and 7 is similar to the construction already described except that the hoop 111 of hanger 110 is oval-shaped and is sectioned, with hoop sections 111*a* and 111*b* capable of being shifted from the contracted positions shown in solid lines in FIG. 7 to the expanded positions depicted in broken lines. As shown most clearly in FIG. 7, section 111*a* (also 111*b*) is provided with reduced end portions 150 that are telescopingly received in tubular sleeves or connecting sections 151. If desired, the ends of each sleeve 151 may be provided with an inner projection or detent 152 that is received in recess 153 of the inner end portion 150 when the hoop sections 111*a* and 111*b* are fully extended. It will also be observed that a pair of arms 112 parallel with sleeves 151 are similarly segmented, being provided with inner and outer telescoping portions 154 and 155, respectively, to permit extension and retraction of the hoop sections. It is believed apparent that the embodiment of FIGS. 6 and 7 has the advantage of limited collapsibility when the hanger is to be stored at home or packed for travel and the further advantage of being expandable to a size most suitable for the garment to be supported by it when use is required. Like the first embodiment, the open area within hoop 111 is at least 80 percent, preferably over 90 percent, of the area defined by the hoop, and the entire hanger is preferably formed of a relatively rigid plastic material.

Figure 8:
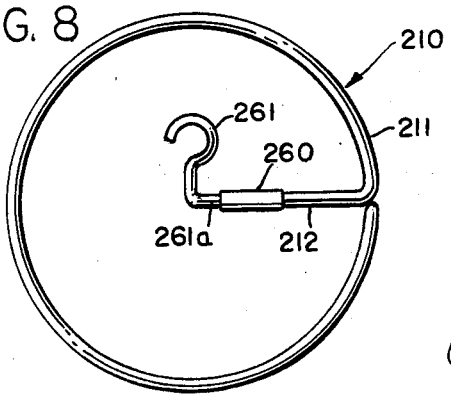
FIG. 8 is a top plan view of a third embodiment.
Figure 10:
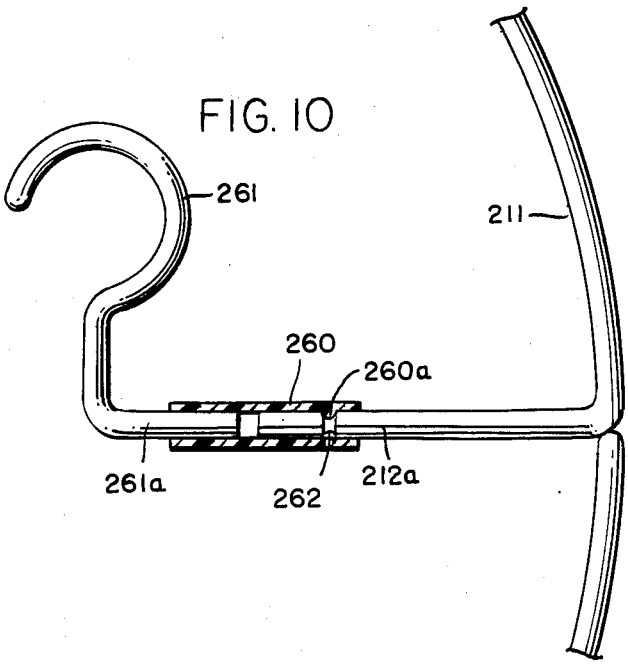
FIG. 10 is an enlarged sectional view showing the relationship of the hoop and hook of the third embodiment.
Figure 9:
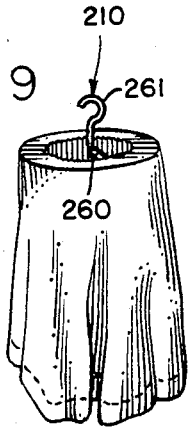
FIG. 9 is a perspective view depicting the hanger of the third embodiment in use.

The embodiment of FIGS. 8–10 is a simplified construction in which hanger 210 has a hoop 211 formed of round stock (preferably rigid plastic) with a single integral arm 212. A sleeve or tubular hub member 260 rotatably receives the inner end 212*a* of arm portion 212. The tubular hub is secured or fixed to hook portion 261 so that the hub and hook portion may be rotatable between the collapsed position shown in FIGS. 8 and 10 and the extended or operative position illustrated in FIG. 9. Alternatively, the hub may be fixed to arm 212 and rotatably receive the shank or stem portion 261*a* of hook 261. If desired, the open end of the tubular hub 260 may be provided with an inner projection 260*a* received in an annular groove 262 of arm 212 to prevent inadvertent separation of the sleeve from the arm. If the sleeve is formed of a slightly resilient material such as, for example, polypropylene or other plastic material having similar properties, or if projection 260*a* is omitted, then hook portion 261 may be detached from the arm portion 212 of the hanger for purposes of storage or travel. However, such detachment would not normally be necessary because when the hook portion 261 is rotated into the plane of circular hoop portion 211 the hanger is sufficiently collapsed for travel or storage. As in the prior embodiments, the open area within hoop 211 is at least 80 percent, and preferably more than 90 percent, of the total area defined by the periphery of the hoop. The diameter of each embodiment (including the maximum diameter of hanger 110 when expanded) falls within the general range of 6 to 15 inches, with a diameter of about 10 inches being preferred.

While in the foregoing I have disclosed several embodiments of the invention for purposes of illustration, it will be understood by those skilled in the art that many of these details may be varied without departing from the spirit and scope of the invention.

I claim:

1. A hanger for supporting washed garments for rapid air drying, said hanger comprising a hoop portion having at least one coplanar arm portion extending inwardly to a central hub portion; and a hook having a stem pivotally connected to said hub portion for pivotal movement of said hook between a retracted position lying along the plane of said hoop portion and an extended position projecting in a direction generally normal to the plane of said hoop portion; said hub portion being provided with a recess defined by a pair of spaced parallel side walls extending axially through said hub portion; said walls having apertures and said stem of said hook portion being provided with a pair of projections pivotally received in said apertures.

2. The hanger of claim 10 in which said hoop, arm, and hub portions are formed of rigid plastic material.

3. The hanger of claim 1 in which said hoop portion is generally circular in outline and has a diameter within the general range of about 6 to 15 inches.

4. The hanger of claim 1 in which said recess is open along one side to accommodate said stem portion when said hook is folded into retracted position.

5. The hanger of claim 4 in which said projections are removable from said apertures for disconnection of said hook from said hub portion.

6. The hanger of claim 1 in which a plurality of said arm portions extend inwardly to said hub portion from said hoop portion.

7. The hanger of claim 1 in which said hoop portion includes a pair of generally semi-circular hoop sections having end portions slidably received in tubular sleeves for sliding movement of said hoop sections between retracted and extended positions.

8. The hanger of claim 1 in which said hoop, arm, and hub portions define at least one air-circulation opening that constitutes at least 80 percent of the area bounded by the periphery of the hoop portion.

9. A hanger for supporting washed garments for rapid air drying, said hanger comprising a hoop portion and at least one coplanar arm portion extending inwardly to a central hub portion; and a hook having a stem with an end portion pivotally connected to said hub portion for pivotal movement of said hook between a retracted position lying along the plane of said hoop portion and an extended position projecting in a direction generally normal to the plane of said hoop portion; said hub portion including a wall defining a recess extending axially through said hub portion and opening in a direction normal to the plane of said hoop portion and along one side in a direction facing said hoop portion; projection means provided by said end portion of said stem; and aperture means provided by said wall of said hub for pivotally receiving said projection means to permit pivotal movement of said hook between said retracted and extended positions.

10. The hanger of claim 9 in which said projection means of said stem is disengageable from said aperture means of said hub for disconnection of said hook from said hub portion.

11. The hanger of claim 9 in which a plurality of said arm portions extend inwardly to said hub portion from said hoop portion.

12. The hanger of claim 9 in which said hoop, arm, and hub portions are integrally formed of rigid plastic material.

* * * * *